US008926363B2

(12) United States Patent
Klein et al.

(10) Patent No.: US 8,926,363 B2
(45) Date of Patent: Jan. 6, 2015

(54) ELECTRICAL CONNECTOR ASSEMBLY

(71) Applicant: Tyco Electronics Corporation, Berwyn, PA (US)

(72) Inventors: David Allen Klein, Kernersville, NC (US); Donald Robert Worthington, Jr., Pfafftown, NC (US); Matthew Chris Peterson, Albert Lea, MN (US)

(73) Assignee: Tyco Electronics Corporation, Berwyn, PA (US)

( * ) Notice: Subject to any disclaimer, the term of this patent is extended or adjusted under 35 U.S.C. 154(b) by 24 days.

(21) Appl. No.: 13/779,208

(22) Filed: Feb. 27, 2013

(65) Prior Publication Data

US 2013/0230996 A1 Sep. 5, 2013

Related U.S. Application Data

(60) Provisional application No. 61/634,547, filed on Mar. 2, 2012.

(51) Int. Cl.

| | |
|---|---|
| ***H01R 13/40*** | (2006.01) |
| ***H01R 13/58*** | (2006.01) |
| ***H01R 13/533*** | (2006.01) |
| *H01R 13/432* | (2006.01) |
| *H01R 13/436* | (2006.01) |
| *H01R 13/52* | (2006.01) |
| *H01R 13/56* | (2006.01) |

(52) U.S. Cl.

CPC ..... *H01R 13/582* (2013.01); *H01R 13/533* (2013.01); *H01R 13/5612* (2013.01); *H01R 13/432* (2013.01); *H01R 13/4364* (2013.01); *H01R 13/5205* (2013.01); *H01R 13/56* (2013.01)

USPC ..... 439/587

(58) Field of Classification Search

USPC ..... 439/587, 271, 274, 352, 752, 588, 467

See application file for complete search history.

(56) References Cited

U.S. PATENT DOCUMENTS 5,520,553 A * 5/1996 Cecil et al. ..... 439/595
5,575,692 A * 11/1996 Cecil et al. ..... 439/752

(Continued)

FOREIGN PATENT DOCUMENTS

EP 0 716 475 A2 6/1996
EP 1 249 914 A1 10/2002

(Continued)

OTHER PUBLICATIONS

International Search Report, International Application No. PCT US2013/028248, International Filing Date, Feb. 28, 2013.

(Continued)

*Primary Examiner* — Alexander Gilman

(57) ABSTRACT

An electrical connector assembly includes a housing having a front end and a rear end and including housing channels extending axially from the front end to the rear end for holding a wire assembly. The connector assembly includes a stabilizer having a front end and a rear end. The stabilizer includes supports extending from the front end with support channels along a longitudinal axis of the stabilizer. The stabilizer is coupled to the rear end of the housing so that the support channels align with the housing channels to accept corresponding wire assemblies therein. A front retaining feature holds the stabilizer to the housing. A rear retaining feature holds the wire assemblies to the stabilizer.

20 Claims, 5 Drawing Sheets

(56) References Cited

U.S. PATENT DOCUMENTS

| | | | | | |
|---|---|---|---|---|---|
| 5,967,859 | A | * | 10/1999 | Cecil et al. | 439/752 |
| 6,132,262 | A | * | 10/2000 | Blanchet | 439/752 |
| 6,162,085 | A | * | 12/2000 | Chugh et al. | 439/467 |
| 6,609,932 | B2 | * | 8/2003 | Fukatsu et al. | 439/588 |
| 7,029,328 | B1 | * | 4/2006 | Mckenzie et al. | 439/587 |
| 7,351,102 | B2 | * | 4/2008 | Cykon et al. | 439/587 |
| 2007/0037433 | A1 | * | 2/2007 | Carnahan | 439/352 |

FOREIGN PATENT DOCUMENTS

| | | | |
|---|---|---|---|
| GB | 2 465 609 | A | 5/2010 |
| WO | 2010 134450 | A1 | 11/2010 |

OTHER PUBLICATIONS

Drawing No. 640719, Strain Relief and Insert 2 Circuit Universal Mate-N-Lok™, Rev. O, Oct. 25, 1978, 1 page, AMP Incorporated.
Drawing No. C-2035047, Backshell Ampseal 16, 0 Degree Exit, Rev. C, Sep. 30, 2011, 1 page, TE Connectivity.

* cited by examiner

ELECTRICAL CONNECTOR ASSEMBLY

CROSS REFERENCE TO RELATED APPLICATIONS

This application claims the benefit of U.S. Provisional Application No, 61/634,547 filed Mar. 2, 2012, titled ELECTRICAL CONNECTOR ASSEMBLY the subject matter of which is herein incorporated by reference in its entirety.

BACKGROUND OF THE INVENTION

The subject matter herein relates generally to electrical connector assemblies having a terminal and wire stabilizer.

In certain applications, electrical connectors may experience violent wire motion due to high vibration exposure. This motion can cause wire or terminal breakage or motion at the terminal interface which may cause wear and connection failure. Traditional connector strain reliefs reduce wire motion, but add weight to the electrical connector and create more eccentric loads on the system due to the eccentric length of the strain relief part when mounted onto the electrical connector.

A need exists for an electrical connector assembly having a stabilizer to reduce the movement of the wire assemblies to avoid damage.

BRIEF DESCRIPTION OF THE INVENTION

In one embodiment, a connector assembly is provided including a housing having a front end and a rear end and including housing channels extending axially from the front end to the rear end for holding a wire assembly. The connector assembly includes a stabilizer having a front end and a rear end. The stabilizer includes supports extending from the front end with support channels along a longitudinal axis of the stabilizer. The stabilizer is coupled to the rear end of the housing so that the support channels align with the housing channels to accept corresponding wire assemblies therein. A front retaining feature holds the stabilizer to the housing. A rear retaining feature holds the wire assemblies to the stabilizer.

Optionally, the front ends of the supports of the stabilizer may abut against a back surface of a seal of the wire assembly to reduce vibration of the wire assembly. The supports may stop rearward movement of the wire assemblies within the housing channels. The supports may be received in the housing channels.

Optionally, the front retaining feature may be a strap pressing the stabilizer to the housing to retain the stabilizer. The rear retaining feature may be a strap pressing the wire assemblies into the support channels to axially affix the wire assemblies to the stabilizer. The stabilizer may include detents extending radially outward therefrom at the rear end. The detents may axially hold the rear retaining feature on the stabilizer.

Optionally, the stabilizer may include tabs extending along an exterior surface of the housing at the rear end of the housing. The front retaining feature may engage the tabs to secure the stabilizer to the housing. The tabs may be positioned radially outward of the supports with gaps defined between the tabs and supports. The rear end of the housing may be positioned in the gaps. The front retaining feature may press the tabs towards the housing to secure the stabilizer toward the housing.

Optionally, the connector assembly may include a terminal positioned assurance device coupled to the housing. The terminal position assurance device may have detents position behind corresponding terminals of the wire assemblies to axially secure the wire assemblies in the housing channels.

Optionally, the wire assemblies may each include a seal affixed to a wire of the wire assemblies rearward of corresponding terminals of the wire assemblies attached to ends of the wires. The wire assemblies may be received in the housing channels such that the seals are axially positioned remote from the front end and remote from the rear end of the housing. The supports may be loaded into the corresponding housing channels to abut against the seal to block rearward movement of the wire assemblies relative to the housing.

In another embodiment, a connector assembly is provided that includes a plurality of wire assemblies each having a wire, a terminal terminated to an end of the wire and a seal surrounding the wire, the seal having a back surface. The connector assembly includes a housing having a front end and a rear end with housing channels extending axially from the front end to the rear end for holding the wire assemblies. A stabilizer is coupled to the rear end of the housing. The stabilizer has supports including support channels receiving corresponding wire assemblies. The supports are loaded into corresponding housing channels such that front ends of the supports abut against the back surfaces of the seals of corresponding wire assemblies. A front retaining feature holds the stabilizer to the housing. A retaining feature holds the wire assemblies to the stabilizer.

DETAILED DESCRIPTION OF THE INVENTION

Figure 1:
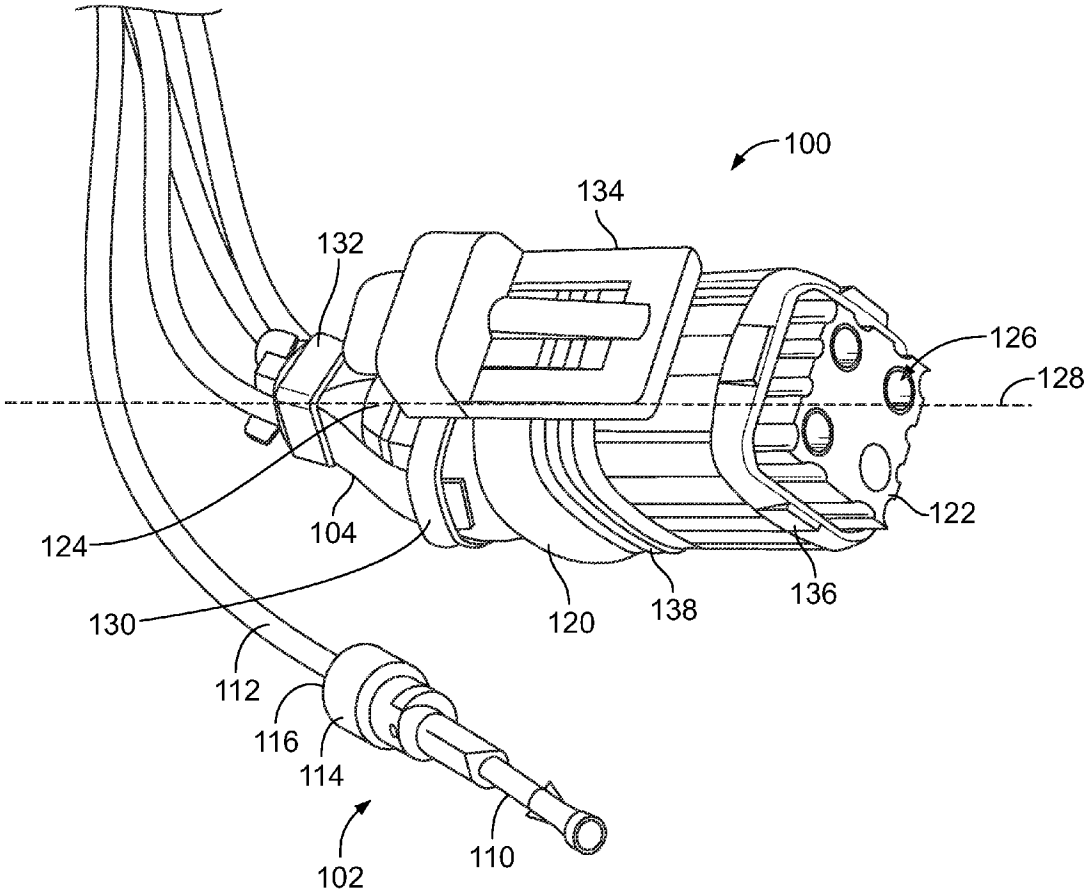
FIG. 1 is a front perspective view of an electrical connector assembly having a stabilizer formed in accordance with an exemplary embodiment.
Figure 2:
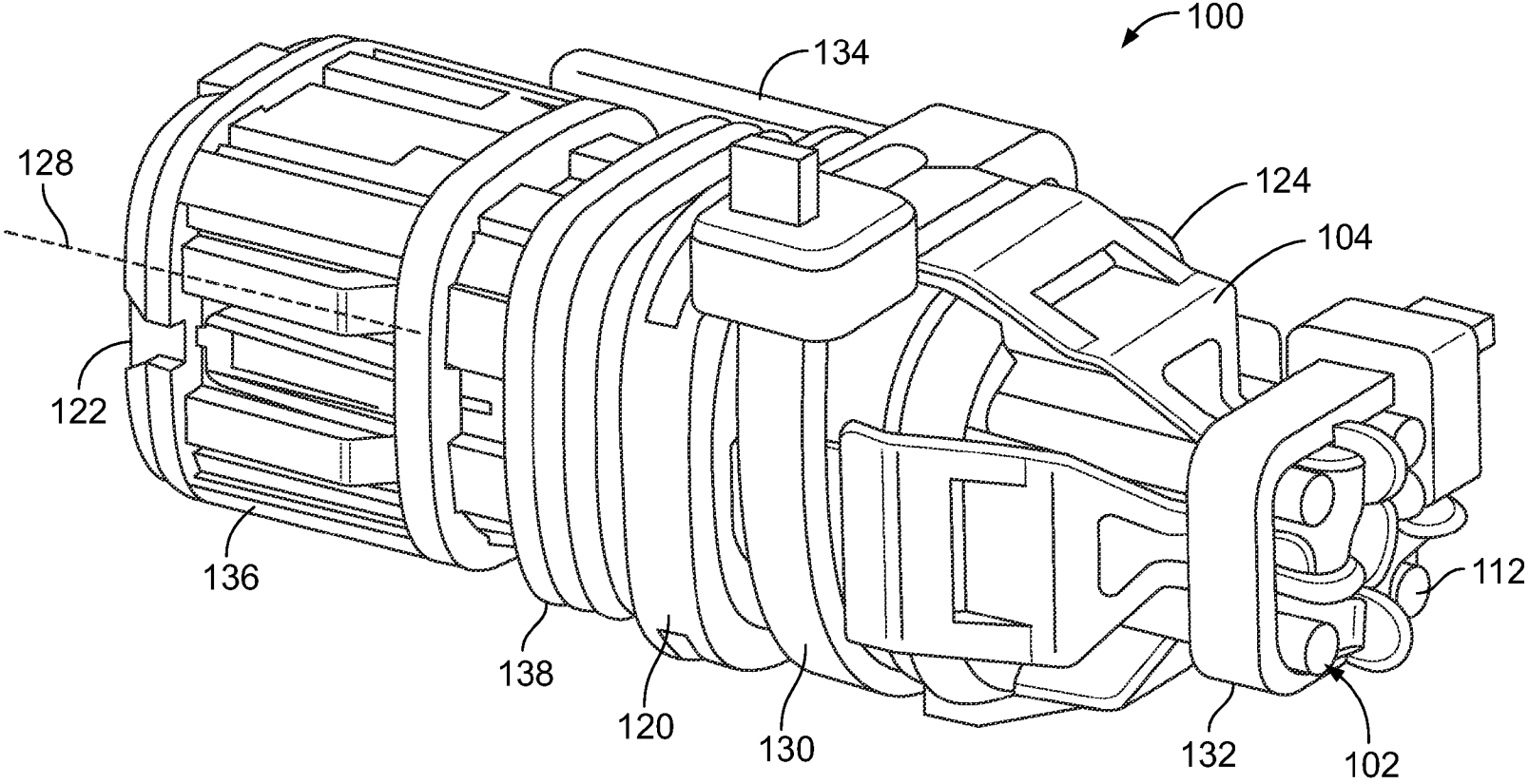
FIG. 2 is a rear perspective view of the electrical connector assembly and stabilizer.

FIG. 1 is a front perspective view of an electrical connector assembly 100 formed in accordance with an exemplary embodiment. FIG. 2 is a rear perspective view of the electrical connector assembly 100. The electrical connector assembly 100 holds a plurality of wire assemblies 102 (one of which is removed from the electrical connector assembly 100 in FIG. 1 for illustration) that are configured to be electrically connected with a mating connector (not shown). The electrical connector assembly 100 includes a stabilizer 104 for stabilizing the wire assemblies 102, such as to reduce movement of the wire assemblies 102 to avoid damage thereto.

Each wire assembly 102 includes a terminal 110 attached to an end of a wire 112. Optionally, the terminal 110 may be crimped to the wire 112. Each wire assembly 102 includes a seal 114 affixed to the wire 112 rearward of the corresponding terminal 110. Optionally, the seal 114 may be crimped to the wire 112. Optionally, the seal 114 may be positioned immediately behind the terminal 110. Alternatively, the seal 114 may be remote from the terminal 110. The seal may be coupled to the terminal 110. The seal 114 prevents moisture, debris or other containments from entering the electrical connector assembly 100 and affecting the electrical performance or connection of the terminal 110 with the mating connector.

In an exemplary embodiment, as described and further detailed below, the stabilizer 104 is configured to engage a back surface 116 of the seal 114 to provide support to the seal 114 and the wire assembly 102. The stabilizer 104 supports the wire assembly 102 against the seal 114.

The electrical connector assembly 100 includes a housing 120 configured to hold the wire assemblies 102. The housing 120 extends between a front end 122 and a rear end 124. The housing 120 includes housing channels 126 extending axially along a longitudinal axis 128 of the housing 120 from the front end 122 to the rear end 124 for holding the wire assemblies 102. The stabilizer 104 is coupled to the housing 120 rearward of the housing 120. The electrical connector assembly 100 includes a front retaining feature 130 holding the stabilizer 104 to the housing 120. The electrical connector assembly 100 includes a rear retaining feature 132 holding the wires assemblies 102 to the stabilizer 104.

In an exemplary embodiment, the housing 120 includes a latch 134 for securing the electrical connector assembly 100 to the mating connector. The latch 134 may be deflectable. In an exemplary embodiment, the electrical connector assembly 100 includes a terminal position assurance device 136 coupled to the housing 120. The terminal position assurance device 136 has features configured to engage the terminals 110 to secure the terminals 110 in the housing channels 126 and assure that the terminals 110 are properly positioned within the housing 120. The electrical connector assembly 100 includes a peripheral seal 138 extending around an exterior of the housing 120. The peripheral seal 138 is configured to be sealed against the mating connector when the electrical connector assembly 100 is mated thereto. The peripheral seal 138 prevents moisture, debris or other containments from entering the electrical connector assembly 100 through the interface with the mating connector.

Figure 3:
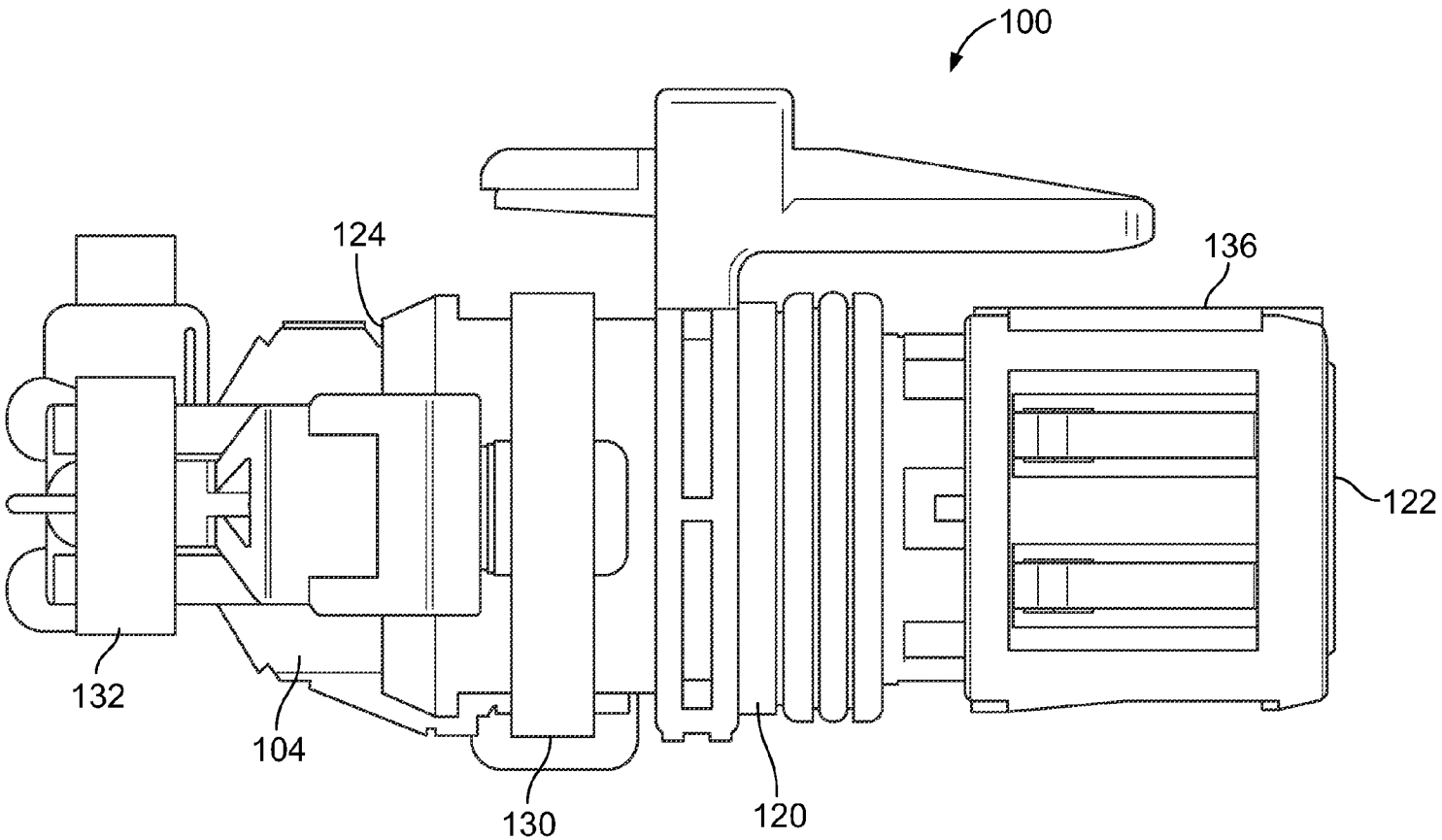
FIG. 3 is a side view of the electrical connector assembly and stabilizer.

FIG. 3 is a side view of the electrical connector assembly 100 showing the terminal position assurance device 136 coupled to the front end 122 of the housing 120 and showing the stabilizer 104 coupled to the rear end 124 of the housing 120. The stabilizer 104 is coupled to the housing 120 using the front retaining feature 130. The wire assemblies 102 are secured to the stabilizer 104 using the rear retaining feature 132.

Figure 4:
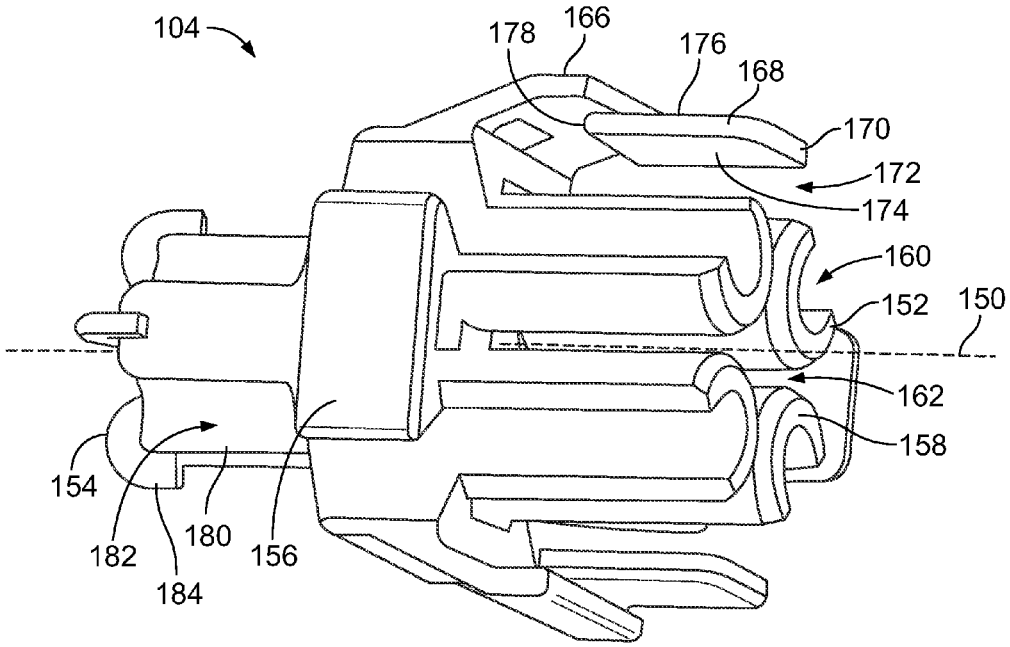
FIG. 4 is a perspective view of the stabilizer.
Figure 5:
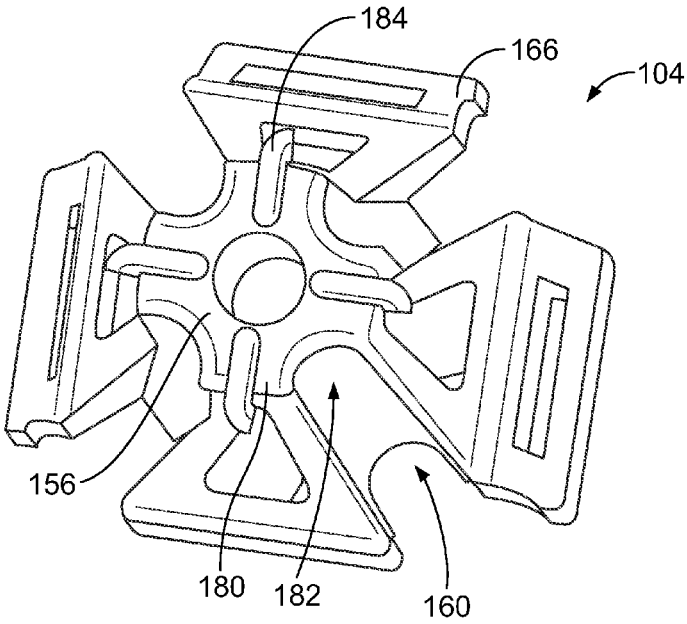
FIG. 5 is a rear perspective view of the stabilizer.

FIG. 4 is a perspective view of the stabilizer 104 formed in accordance with an exemplary embodiment. FIG. 5 is a rear perspective view of the stabilizer 104. The stabilizer 104 extends along a longitudinal axis 150 between a front end 152 and a rear end 154. The stabilizer 104 includes a hub 156, which may be approximately centered between the front end 152 and the rear end 154. The stabilizer 104 includes a plurality of supports 158 at the front end 152. The supports 158 extend forward from the hub 156. Any number of supports 158 may be provided. The number of supports 158 corresponds with the number of wire assemblies 102 (shown in FIG. 1) that are supported by the stabilizer 104. The supports 158 each includes a corresponding support channel 160 extending along the longitudinal axis 150. In an exemplary embodiment, the support channels 160 are open sided such that the support channels 160 are configured to receive corresponding wires 112 (shown in FIG. 1) in a radial loading direction through the open side of the support channel 160. In an exemplary embodiment, at the front end 152 the supports 158 are generally C-shaped to form the support channels 160 along the longitudinal axis of each support 158. The supports 158 are separated from each other by gaps 162. The gaps 162 provide a space configured to receive a portion of the housing 120 (shown in FIG. 1).

The stabilizer 104 includes outer latches 166 extending forward from the hub 156. The outer latches 166 are deflectable and are used to secure the stabilizer 104 to the housing 120. The outer latches 166 include tabs 168 at distal ends thereof. The tabs 168 extend to free ends 170. The tabs 168 are generally axially aligned with the supports 158. The tabs 168 are positioned radially outward of the supports 158. The tabs 168 are cantilevered and extend forward from the hub 156. Gaps 172 are defined between the tabs 168 and the supports 158. The tabs 168 are configured to extend along an exterior of the housing 120. The tabs 168 are used to secure the stabilizer 104 to the housing 120 using the front retaining feature 130 (shown in FIG. 1). The tabs 168 each have an inner surface 174 and an outer surface 176 opposite the inner surface 174. Each of the tabs 168 includes a rear facing surface 178.

The stabilizer 104 includes a rear hub 180 rearward of the hub 156. The rear hub 180 may be a rearward extension of the supports 158 and may define portions of the supports 158. The rear hub 180 supports the wires 112 of the wire assemblies 102. The rear hub 180 includes channels 182 aligned with the support channels 160 that support the wires 112. The channels 182 may define support channels and may be referred to as support channels 182. The rear retainer feature 132 is configured to be coupled to the rear hub 180. The rear hub 180 includes detents extending radially outwardly therefrom at the rear end 154. The detents 184 are used to secure the rear retaining feature 132 to the stabilizer 104.

Figure 6:
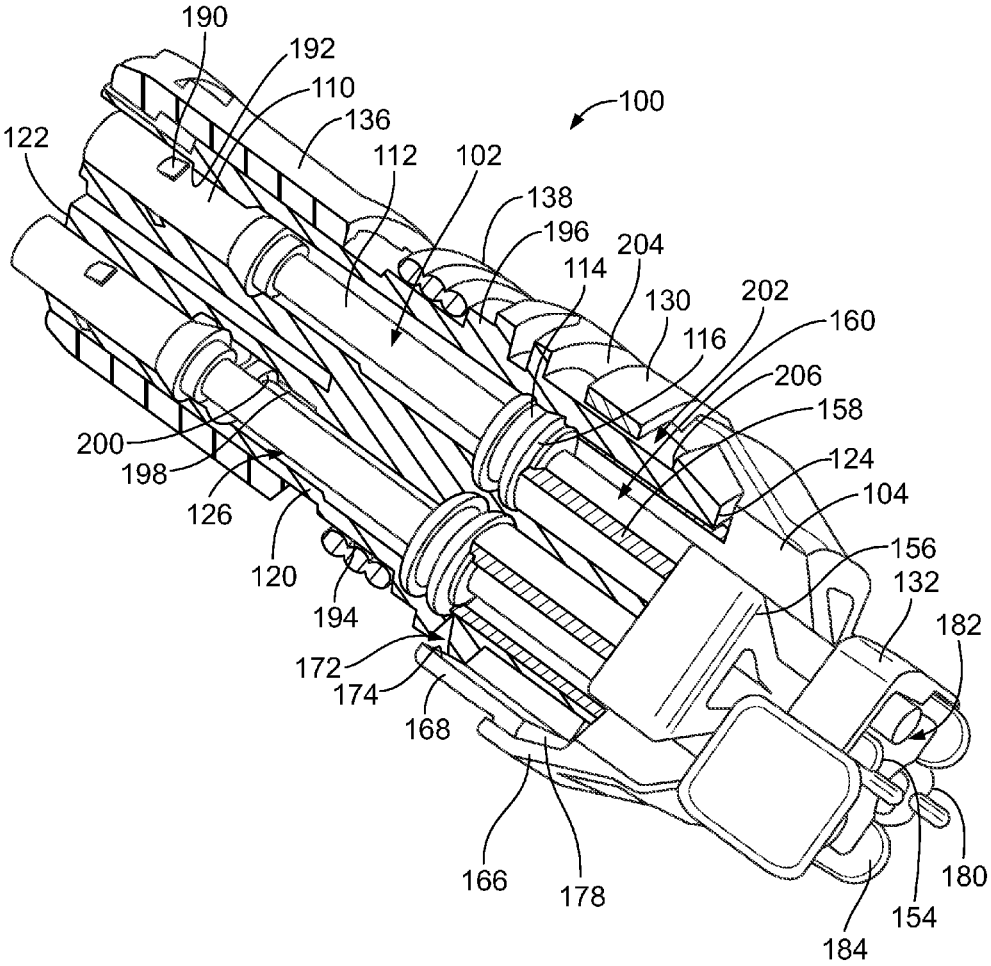
FIG. 6 is a partial sectional view of a portion of the electrical connector assembly.

FIG. 6 is a partial sectional view of a portion of the electrical connector assembly 100. During assembly, the wire assemblies 102 are loaded into the housing channels 126 through the rear end 124 of the housing 120. In an exemplary embodiment, the terminals 110 may be positioned at the front end 122 of the housing 120. The terminals 110 include latches 190 that are configured to engage corresponding shoulders 192 in the housing channels 126 to secure the terminal 110 within the housing channels 126.

The terminal position assurance device 136 and peripheral seal 138 are coupled to the housing 120 from the front end 122. The peripheral seal 138 is sized and shaped to fit over a front profile 194 along an exterior of the housing 120 to a seated position adjacent a ridge 196 of the housing 120. The terminal position assurance device 136 is positioned forward of the peripheral seal 138. The terminal position assurance device 136 includes detents 198 extending through slots or grooves in the housing 120 to engage a rear facing shoulder 200 of the terminal 110. The detents 198 stop rearward movement of the terminals 110 within the housing channels 126. The detents 198 operate as a secondary or backup latch for securing the terminal 110 within the housing 120 in addition to the latch 190 of the terminal 110. For example, if the latches 190 were to fail or break, the detents 198 would secure the terminals 110 within the housing 120. The terminal position assurance device 136 provides locking for the terminals 110 in the fully loaded position. The terminal position device 136 may be locked in position to ensure that the terminals 110 are positioned in the housing 120.

During assembly, the stabilizer 104 is coupled to the rear end 124 of the housing 120. The wires 112 are loaded into corresponding support channels 160, 182 of the stabilizer 104, such as by loading the wires 120 through the open sides of the support channels 160, 182. The wire assemblies 102 are received in the housing channels 126 such that the seals 114 are axially positioned remote from the front end 122 and remote from the rear end 124 of the housing 120. The stabilizer 104 is coupled to the rear end 124 such that the supports 158 are loaded into corresponding housing channels 126 to abut against the seals 114 to block rearward movement of the wire assemblies 102 relative to the housing 120. The front ends of the supports 158 define the front end 122 of the stabilizer 104 and abut against the back surfaces 116 of corresponding seals 114 of the wire assemblies 102. The supports 158 stabilize the wire assemblies 102 within the housing 120. The supports 158 hold firmly against the individual wires seals 114 crimped onto each wire 112 thus holding the terminal forward to reduce terminal motion. The direct engagement between the stabilizer 104 and the wire assemblies 102 reduces movement of the wire assemblies 102. The supports 158 stop axial movement of the wire assemblies 102 in a rearward direction thus reducing stresses and strains on the terminals 110 and reducing terminal motion at the interface between the terminals and corresponding mating connector. In an exemplary embodiment, portions of the wires 112 are captured between the support channels 160 and the housing channels 126. The housing channels 126 cap or close the open sided portions of the C-shaped support channels 160.

The rear retaining feature 132 secures the wires 112 to the stabilizer 104. The rear retaining feature 132 is coupled to the rear hub 180 and presses the wires 112 into the channels 182 to secure the wires 112 relative to the stabilizer 104. The rear retaining feature 132 reduces much of the wire motion potentially translated to the terminal interface without the wire stabilization. In an exemplary embodiment, the rear retaining feature 132 is a strap configured to be tightened against the wires 112 and stabilizer 104. For example, the rear retaining feature 132 may be a tie wrap or a zip tie that may be tightened and locked in place. Other types of retaining features may be used in alternative embodiments, such as a C-clamp. The rear retaining feature 132 presses the wires 112 of the wire assemblies 102 into the support channels 160 and/or channels 182 to axially affix the wire assemblies 102 to the stabilizer 104. The rear retaining feature 132 provide strain relief. The rear retaining feature 132 is coupled to the rear hub 180 between the hub 156 and the detents 184. The detents 184 stop the rear retaining feature 132 from slipping off the rear end 154 of the stabilizer 104.

During assembly, as the stabilizer 104 is coupled to the rear end 124 of the housing 120, the outer latches 166 engage the housing 120 to secure the stabilizer 104 to the housing 120. The stabilizer 104 is held on the housing 120 using the front retaining feature 130. The housing 120 includes a rear groove section 202 rearward of a flange 204. The housing 120 includes a lip 206 rearward of the rear groove section 202. The stabilizer 104 is assembled onto the rear groove section 202 of the housing 120. As the stabilizer 104 is coupled to the rear end 124 of the housing 120, the rear end 124 of the housing 120 is loaded into the gaps 172 between the outer latches 166 and the supports 158. The tabs 168 pass over the lip 206 and are seated in the rear groove section 202. The inner surface 174 of each tab 168 rests on the exterior surface of the housing 120 defined along the rear groove section 202. The supports 158 are inside of the housing 120 and the tabs 168 are outside of the housing 120.

When the stabilizer 104 is positioned on the housing 120, the rear facing surface 178 of each outer latch 166 abuts against the lip 206 to axially secure the stabilizer 104 with respect to the housing 120. The lip 206 prevents rearward movement of the stabilizer 104 and prevents the stabilizer 104 from being pulled off the rear end 124 of the housing 120. The tabs 168 extend parallel to and along the rear groove section 202. The front retaining feature 130 surrounds the tabs 168 and prevents the tabs 168 from lifting off of the rear groove section 202. The front retaining feature 130 presses the tabs 168 toward the housing 120 to secure the stabilizer 104 to the housing 120. For example, the tabs 168 are unable to lift off of the rear groove section 202 such that the rear facing surface 178 is unable to clear the lip 206. The stabilizer 104 is secured to the housing 120 and is unable to be pulled rearward off of the housing 120. With the stabilizer 104 secured in place on the housing 120, the stabilizer 104 provides support for the wire assemblies 102 for terminal motion.

In an exemplary embodiment, the front retaining feature 130 is a strap configured to be tightened and press the tabs 168 of the stabilizer 104 against the rear groove section 202 of the housing 120 to retain the stabilizer 104 on the housing 120. For example, the front retaining feature 130 may be a tie rap or a zip tie that may be tightened or locked into place. Other types of retaining features may be used in alternative embodiments, such as a C-clamp.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing having a front end and a rear end, and including housing channels extending axially from the front end to the rear end for holding wire assemblies;

a stabilizer having a front end and a rear end, the stabilizer including supports extending from the front end, the supports having support channels along a longitudinal axis of the stabilizer, the stabilizer being coupled to the rear end of the housing so that the support channels align with the housing channels to accept corresponding wire assemblies therein;

a front retaining feature holding the stabilizer to the housing, wherein the front retaining feature comprises a strap pressing the stabilizer to the housing to retain the stabilizer; and a rear retaining feature holding the wire assemblies to the stabilizer.

2. The electrical connector assembly of claim 1, wherein the front end of the stabilizer abuts against a back surface of a seal of each wire assembly to reduce vibration of the wire assembly.

3. The electrical connector assembly of claim 1, wherein the supports stop rearward movement of the wire assemblies within the housing channels.

4. The electrical connector assembly of claim 1, wherein the supports are received in the housing channels.

5. The electrical connector assembly of claim 1, wherein the rear retaining feature comprises a strap pressing the wire assemblies into the support channels to axially affix the wire assemblies to the stabilizer.

6. The electrical connector assembly of claim 1, wherein the stabilizer includes tabs extending along a rear groove section of the housing at the rear end of the housing, the front retaining feature engaging the tabs to secure the stabilizer to the housing.

7. The electrical connector assembly of claim 1, further comprising a terminal positioned assurance device coupled to the housing, the terminal position assurance device having detents position behind corresponding terminals of the wire assemblies to axially secure the wire assemblies in the housing channels.

8. The electrical connector assembly of claim 1, wherein the wire assemblies each comprise a seal affixed to a wire of the wire assemblies rearward of corresponding terminals of the wire assemblies attached to ends of the wires, the wire assemblies being received in the housing channels such that the seals are axially positioned remote from the front end and remote from the rear end of the housing, the supports being loaded into the corresponding housing channels to abut against the seal to block rearward movement of the wire assemblies relative to the housing.

9. The electrical connector assembly of claim 1, wherein the stabilizer includes detents extending radially outward therefrom at the rear end, the detents axially holding the rear retaining feature on the stabilizer.

10. An electrical connector assembly comprising:

a housing having a front end and a rear end, and including housing channels extending axially from the front end to the rear end for holding wire assemblies;

a stabilizer having a front end and a rear end, the stabilizer including supports extending from the front end, the supports having support channels along a longitudinal axis of the stabilizer, the stabilizer being coupled to the rear end of the housing so that the support channels align with the housing channels to accept corresponding wire assemblies therein, wherein the stabilizer includes tabs positioned radially outward of the supports, gaps defined between the tabs and supports, the rear end of the housing being positioned in the gaps;

a front retaining feature holding the stabilizer to the housing, the front retaining feature pressing the tabs towards the housing to secure the stabilizer to the housing; and a rear retaining feature holding the wire assemblies to the stabilizer.

11. The electrical connector assembly of claim 10, wherein the front retaining feature comprises a strap pressing the stabilizer to the housing to retain the stabilizer.

12. The electrical connector assembly of claim 10, wherein the rear retaining feature comprises a strap pressing the wire assemblies into the support channels to axially affix the wire assemblies to the stabilizer.

13. An electrical connector assembly comprising:

a plurality of wire assemblies, each wire assembly having a wire, a terminal terminated to an end of the wire and a seal surrounding the wire, the seal having a back surface;

a housing having a front end and a rear end, the housing having housing channels extending axially from the front end to the rear end for holding the wire assemblies;

a stabilizer is coupled to the rear end of the housing, the stabilizer includes supports extending to a front end of the stabilizer, the supports having support channels receiving corresponding wire assemblies, the supports being loaded into corresponding housing channels such that front end of the stabilizer abuts against the back surfaces of the seals of corresponding wire assemblies;

a front retaining feature holding the stabilizer to the housing; and a rear retaining feature holding the wire assemblies to the stabilizer, wherein the rear retaining feature comprises a strap pressing the wire assemblies into the support channels to axially affix the wire assemblies to the stabilizer.

14. The electrical connector assembly of claim 13, wherein the supports stop rearward movement of the wire assemblies within the housing channels.

15. The electrical connector assembly of claim 13, wherein the wires are captured between the support channels and the housing channels.

16. The electrical connector assembly of claim 13, wherein the front retaining feature comprises a strap pressing the stabilizer to the housing to retain the stabilizer.

17. The electrical connector assembly of claim 13, wherein the stabilizer includes tabs extending along a rear groove section of the housing at the rear end of the housing, the front retaining feature engaging the tabs to secure the stabilizer to the housing.

18. The electrical connector assembly of claim 13, wherein the stabilizer includes tabs positioned radially outward of the supports, gaps defined between the tabs and supports, the rear end of the housing being positioned in the gaps, the front retaining feature pressing the tabs towards the housing to secure the stabilizer to the housing.

19. The electrical connector assembly of claim 13, further comprising a terminal positioned assurance device coupled to the housing, the terminal position assurance device having detents position behind corresponding terminals of the wire assemblies to axially secure the wire assemblies in the housing channels.

20. The electrical connector assembly of claim 13, wherein the stabilizer includes detents extending radially outward therefrom at the rear end, the detents axially holding the rear retaining feature on the stabilizer.

* * * * *